US009091063B2

(12) United States Patent
Ting

(10) Patent No.: US 9,091,063 B2
(45) Date of Patent: Jul. 28, 2015

(54) HIDDEN FRAME AIRLOOP WINDOW WALL UNIT

(71) Applicant: Advanced Building Systems, Inc., Wilmington, DE (US)

(72) Inventor: Raymond M. L. Ting, Pittsburgh, PA (US)

(73) Assignee: Advanced Building Systems, Inc., Wilmington, DE (US)

( * ) Notice: Subject to any disclaimer, the term of this patent is extended or adjusted under 35 U.S.C. 154(b) by 0 days.

(21) Appl. No.: 14/444,840

(22) Filed: Jul. 28, 2014

(65) Prior Publication Data

US 2015/0027072 A1 Jan. 29, 2015

Related U.S. Application Data

(60) Provisional application No. 61/858,705, filed on Jul. 26, 2013.

(51) Int. Cl.

| | |
|---|---|
| ***E04H 1/00*** | (2006.01) |
| ***E04B 2/88*** | (2006.01) |
| ***E04B 2/90*** | (2006.01) |
| ***E04B 2/92*** | (2006.01) |
| ***E04B 2/96*** | (2006.01) |

(52) U.S. Cl.

CPC . *E04B 2/885* (2013.01); *E04B 2/88* (2013.01); *E04B 2/90* (2013.01); *E04B 2/92* (2013.01); *E04B 2/96* (2013.01)

(58) Field of Classification Search

CPC ..... E04B 2/88; E04B 2/90; E04B 2/92; E04B 2/96; E04B 2/885; E04B 2/962; E04B 2/965

USPC ..... 52/204, 204.57, 204.593, 204.597, 52/204.6, 213, 235

See application file for complete search history.

(56) References Cited

U.S. PATENT DOCUMENTS

| | | | |
|---|---|---|---|
| 4,543,755 | A | 10/1985 | Crandell |
| 4,685,263 | A | 8/1987 | Ting |
| 4,765,107 | A | 8/1988 | Ting |
| 4,783,938 | A | 11/1988 | Palmer |
| 4,840,004 | A | 6/1989 | Ting |
| 4,873,805 | A | 10/1989 | Ting |

(Continued)

FOREIGN PATENT DOCUMENTS

| | | |
|---|---|---|
| GB | 2179391 | 3/1987 |

OTHER PUBLICATIONS

Notification of Transmittal of the International Search Report and the Written Opinion of the International Searching Authority, or the Declaration, Nov. 13, 2014, for PCT Application Serial No. PCT/US2014/048504.

*Primary Examiner* — Jeanette E Chapman
*Assistant Examiner* — James Buckle, Jr.
(74) *Attorney, Agent, or Firm* — Beck & Thomas, P.C.

(57) ABSTRACT

Hidden frame airloop wall systems. The airloop wall systems disclosed here provide for systems that may accommodate various types of glass, including vision glass and spandrel glass. In some examples, the same airloop wall unit may accommodate both a vision glass panel and a spandrel glass panel. The disclosed airloop wall systems permit the use of glass of varying thickness, while at the same time presenting a consistent surface. Additionally, the window frame will be hidden from exterior view after the airloop wall system is installed.

10 Claims, 6 Drawing Sheets

(56) References Cited

U.S. PATENT DOCUMENTS

| | | | | |
|---|---|---|---|---|
| 5,381,637 | A | 1/1995 | Farag | |
| 5,452,552 | A | 9/1995 | Ting | |
| 5,596,851 | A | 1/1997 | Ting | |
| 5,598,671 | A | 2/1997 | Ting | |
| 5,687,524 | A | 11/1997 | Ting | |
| 5,713,167 | A | 2/1998 | Durham | |
| 6,269,600 | B1 * | 8/2001 | Tambakakis | 52/235 |
| 6,393,778 | B1 | 5/2002 | Ting | |
| 6,591,562 | B2 | 7/2003 | Ting | |
| 6,598,361 | B2 | 7/2003 | Ting | |
| 7,134,247 | B2 | 11/2006 | Ting | |
| 8,001,738 | B2 | 8/2011 | Ting | |
| 8,191,325 | B2 | 6/2012 | Ting | |
| 2003/0221381 | A1 | 12/2003 | Ting | |
| 2013/0000232 | A1 | 1/2013 | Weiss et al. | |

* cited by examiner

HIDDEN FRAME AIRLOOP WINDOW WALL UNIT

CROSS-REFERENCE TO RELATED APPLICATIONS

This application claims the benefit under 35 U.S.C. §119 (e) of the earlier filing date of U.S. Provisional Patent Application No. 61/858,705 filed on Jul. 26, 2013.

BACKGROUND OF THE INVENTION

1. Field of Invention

This invention is generally related to the building trades and more specifically to the building envelope system design applicable to an exterior wall design in an airloop wall system.

2. Description of the Background

An exterior wall is formed by multiple wall units joined and sealed between two adjacent wall units in both horizontal and vertical directions. The major functions of an exterior wall include the aesthetic design provided by the project architect and the interior environmental protection design provided by the exterior wall system designer or supplier. It is well recognized in the industry that wind load resistance and water-tightness performance are the two most important functions in the interior environmental protection design. The airloop wall system disclosed in U.S. Pat. No. 8,001,738 by Ting, which is hereby incorporated by reference, provides superior water-tightness performance as well as construction tolerance adjustment. However, the disclosed system has limited construction applications and is best suited for an exposed frame panel unit. Since a hidden frame system is preferred by most architects, it is desirable to provide a hidden frame airloop wall unit with the ability to accommodate both vision glass and spandrel pane within the same unit.

SUMMARY OF THE INVENTION

One objective of the present invention is to provide a hidden frame vision glass airloop window wall unit compatible with the base track and the ceiling track system disclosed in U.S. Pat. No. 8,001,738.

A second objective of the invention is to provide a hidden frame airloop wall unit having a vision glass and a spandrel pane within the same unit and compatible with the base track and the ceiling track system disclosed in U.S. Pat. No. 8,001,738.

The present invention provides an airloop wall system that includes a plurality of perimeter frame members that define a space into which a glass panel will be placed. The space is commonly a rectangular space, though other geometries may be used as dictated by the architectural problem at hand. Each of the perimeter frame members is secured to one another through miter-matched connections. The perimeter frame members may possess an L-shaped cross-sectional geometry that is able to accommodate a glass panel having a support component that is parallel to the face of the glass panel, on which the glass panel may rest, and a perimeter component that extends perpendicularly from the support component towards the exterior of the airloop wall system. That perimeter component may also include a water-repelling gasket. The perimeter frame member at the top of the window wall system is the head frame member, and the perimeter frame member at the bottom of the window wall system is a sill frame member. The head and sill frame members include an interior component adapted to permit the airloop wall system to be secured to a building. The sill frame member may also include air holes to equalize the pressure in the airloop with the exterior pressure.

The glass panel may be secured to the support component through an adhesive. On its exterior face, the glass panel may be sealed in place with a water seal that is located between the glass panel and the perimeter component, such that an airloop is formed between the perimeter frame unit and the glass panel. The present invention thus provides a window wall unit where the perimeter frame members are hidden from view from the exterior of the airloop wall system when the glass panel is secured in place.

The present invention further provides an airloop wall system where the glass panel may be vision glass or spandrel glass. When spandrel glass is employed, the airloop wall system may also include a spacer member (e.g., tube or structural block) that is located between the spandrel glass and the support component of the perimeter frame. That allows the external face of the airloop wall system to maintain constant and smooth dimensions even if multiple types of glass are employed.

The glass panel may be treated with a glaze over its exterior surface to provide it with desired physical attributes.

The present invention also provides an airloop wall system capable of accommodating multiple panels in a single wall unit. For example, the panels may be fabricated from different types of glass. For example, one panel may be vision glass, while the other may be spandrel glass. In these embodiments, the airloop wall system is similar to the single-panel system, but additionally includes a stack member that divides the rectangular space in which the panels will be placed into two spaces—one for each of the two panels. The stack member spans between perimeter frame members on opposite sides of the space. For example, the stack member may run horizontally from the left perimeter member to the right perimeter member, dividing the space into upper and lower panels. Like the sill frame member and the head frame member, the stack member also includes a cross-sectional profile that allows glass panels to be attached to the stack unit with adhesive and forms an airloop around each of the glass panels. The dimensions of the stack member are set by the relative thickness of the first and second glass panels. Preferably, the exterior surface of the airloop wall system is at the same height, even though different types of glass are used in each panel.

BRIEF DESCRIPTION OF THE DRAWINGS

To be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the invention, while eliminating, for purposes of clarity, other elements that may be well known. The detailed description will be provided herein below with reference to the attached drawings.

The present invention addresses the limitations currently existing within the art and provides a hidden frame airloop wall unit. The present invention also provides airloop wall units that are capable of accommodating both vision glass and spandrel pane within the same unit, while at the same time having a smooth exterior surface.

Figure 1:
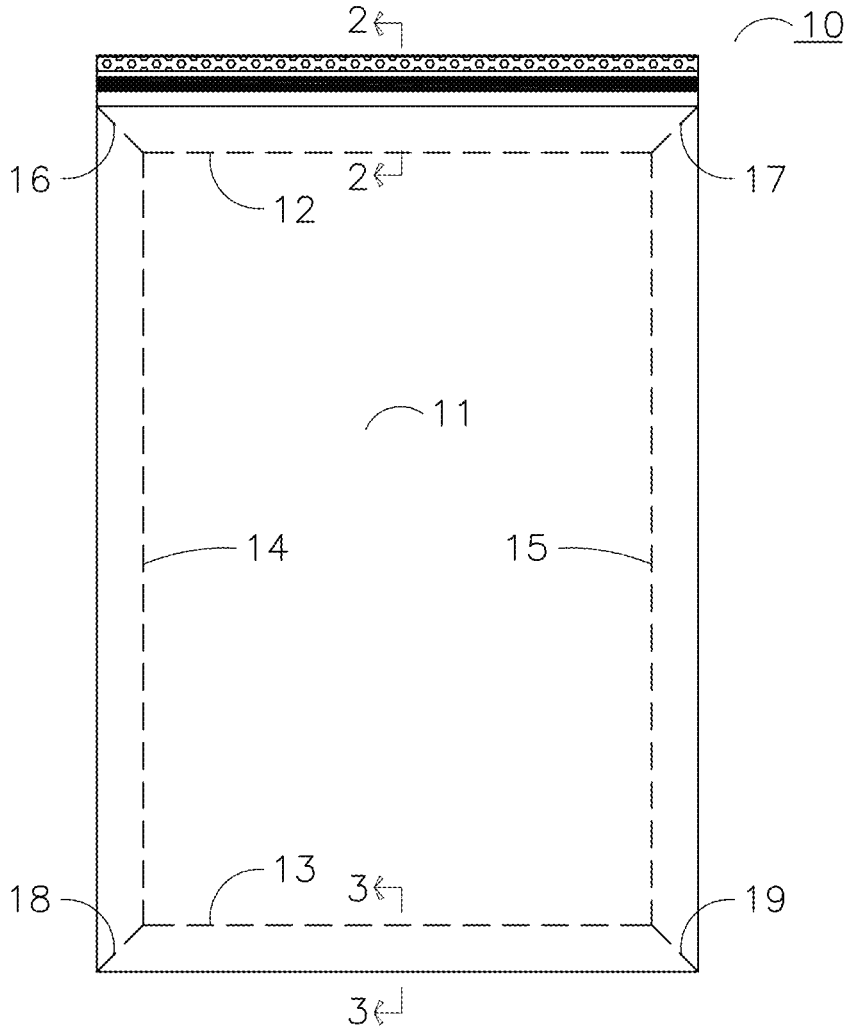
FIG. 1 shows the front view of a typical hidden frame vision glass airloop wall unit of the present invention.

FIG. 1 shows the front view of a typical hidden frame airloop window wall unit 10 of the present invention having vision glass 11 and four perimeter frame members 12, 13, 14, and 15 hidden behind the vision glass 11. The four perimeter frame members 12, 13, 14, and 15 have compatible cavity profiles such that an inner airloop is formed when the frames are miter-match connected at the four corners 16, 17, 18, and 19. Frame member 12 is the head member which is situated at the erected top position of unit 10. Member 13 is the sill member which is situated at the erected bottom position of unit 10. Members 14 and 15 are the jamb members which are situated at the erected sides of unit 10. Together these four perimeter frame members define a space in which a glass panel will be placed. As shown for illustration purposes, the unit 10 in FIG. 1 is generally a rectangular unit with four perimeter frame members. However, the unit can be formed with at least one perimeter member in a rounded shape or any other shape with any multiple straight perimeter members miter-matched at all appropriate intersection points. As shown, the hidden frame airloop window wall unit 10 is shop-assembled in the following sequential steps: (1) provide structural connecting mechanisms at each miter-matched corner to form an empty frame consisting of the four members 12, 13, 14, and 15; (2) glaze in the vision glass 11 to form the completed unit 10.

Figure 1A:
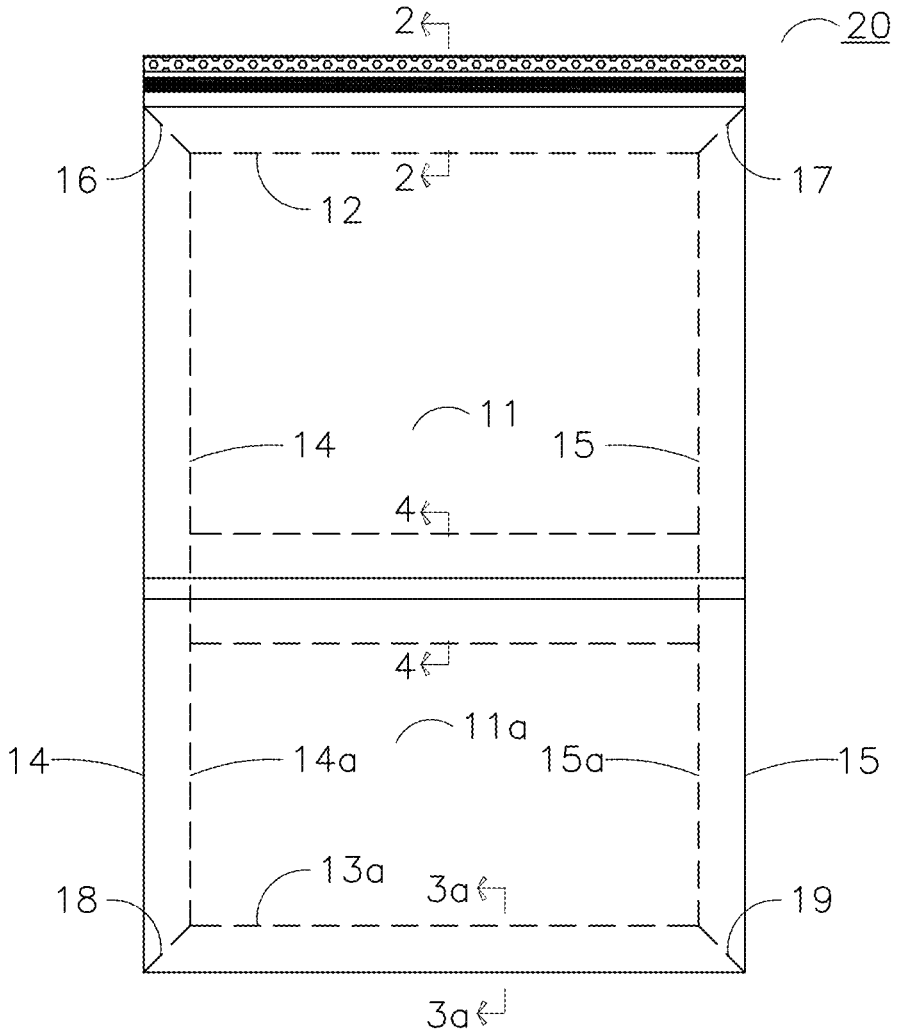
FIG. 1A shows the front view of a typical hidden frame airloop window wall unit with a vision glass and a spandrel pane within the same unit of the present invention.

FIG. 1A shows the front view of a typical hidden frame airloop window wall unit 20 of the present invention having vision glass 11 and a spandrel pane 11*a* within the same unit and four perimeter frame members 12, 13, 14, and 15 hidden behind the vision glass 11 and the spandrel pane 11*a*. A stack member 41 is used to separate vision glass 11 from spandrel pane 11*a*. The four perimeter frame members 12, 13, 14, and 15 have compatible cavity profiles such that an inner airloop is formed when the frames are miter-match connected at the four corners 16, 17, 18, and 19. The lower part of the perimeter frame members 13, 14, and 15 are further supplemented with additional members 13*a*, 14*a*, and 15*a* to accommodate the spandrel pane 11*a*. Member 12 is the head member which is situated at the erected top position of unit 20. Member 13 is the sill member which is situated at the erected bottom position of unit 20. Members 14 and 15 are the jamb members which are situated at the erected sides of unit 20.

Figure 2:
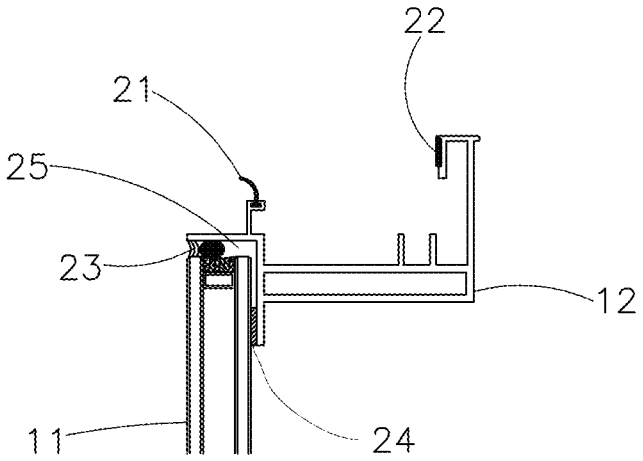
FIG. 2 is the fragmental cross-section of the head frame taken along Line 2-2 of FIG. 1 or FIG. 1A.

FIG. 2 shows the fragmental cross-sectional details of the head perimeter frame member taken along Line 2-2 of FIG. 1 or FIG. 1A. The head perimeter frame member includes a glass panel-accommodating portion which is capable of accepting a glass panel. The head perimeter frame member also includes an interior component that allows the airloop wall unit to be attached to the building, as described in U.S. Pat. No. 8,001,738. The glass panel-accommodating portion of the head perimeter frame member includes a vertically oriented support component that provides a flat surface onto which the glass panel may rest. The glass panel-accommodating portion also includes a perimeter portion oriented perpendicularly to the glass panel and to the support component that defines the perimeter of the space in which the glass panel will be placed. The vision glass panel 11 may be structurally secured to the head perimeter frame member 12 with an adhesive 24 around the edges of vision glass panel 11. The adhesive 24 also acts as the air seal of the unit 10. The water seal 23 around the exterior edges of the vision glass 11 is provided to create the airloop space 25 between the water seal 23 and the air seal 24. The water-repelling gasket 21 and the unit air seal 22 may also be shop installed to complete the shop-assembling process.

Figure 3:
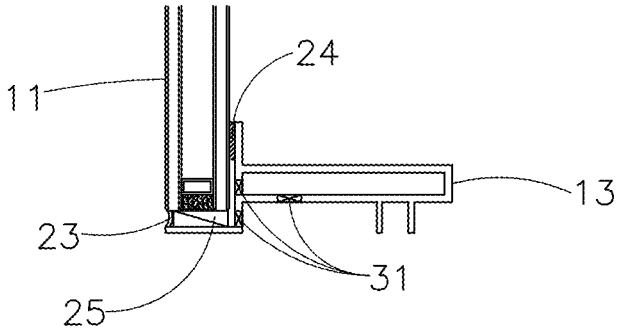
FIG. 3 is the fragmental cross-section of the sill frame taken along Line 3-3 of FIG. 1.

FIG. 3 shows the fragmental cross-sectional details of the sill frame taken along Line 3-3 of FIG. 1. The vision glass panel 11 is structurally secured to the sill perimeter frame member 13 with an adhesive 24 around the edges of vision glass panel 11. Just as with the head perimeter frame member, the sill perimeter frame member also includes a glass panel-accommodating portion adapted to receive a glass panel and an interior component that allows the airloop wall unit to be attached to the building, as described in U.S. Pat. No. 8,001,738. The adhesive 24 also acts as the air seal of the unit 10. The water seal 23 around the exterior edges of the vision glass 11 is provided to create the airloop space 25 between the water seal 23 and the air seal 24. Air holes 31 are provided in the sill frame 13 such that the airloop space 25 can be pressure equalized to the exterior air.

Figure 3A:
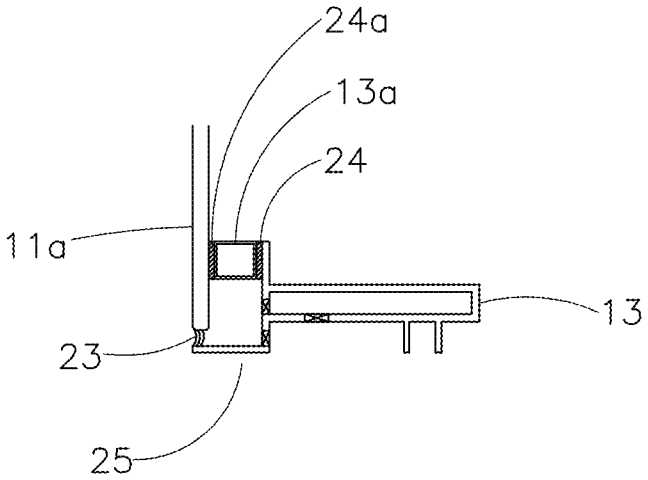
FIG. 3A is the fragmental cross-section of the sill frame taken along Line **3*a*-3*a* of FIG. 1A.

FIG. 3A shows the fragmental cross-sectional details of the sill frame taken along Line 3*a*-3*a* of FIG. 1A. In some embodiments of the window wall system, the jamb frames 14 and 15 may have the same profile as the sill frame 13 and are the major structural members for transferring the wind load on the unit into the base and the ceiling tracks. Therefore, the jamb frames are preferably continuous from the base track to the ceiling track. In some embodiments, the jamb members do not include an interior portion that allows them to be attached to the building. In those embodiments, the airloop wall system is attached to the building primarily through the head and sill perimeter frame members.

Once the perimeter frame members 13, 14, and 15 have been profiled for the vision glass panel 11, the perimeter frame members may be supplemented to accommodate a thinner spandrel pane 11*a*. This can be accomplished by inserting an additional spacer member 13*a* into the gap between the spandrel pane 11*a* and the panel frame member 13 and structurally secure 13*a* with adhesive 24*a*. The spacer member 13*a* may be a structural block or tube, the dimensions of which are chosen to accommodate the varied thickness of the glass employed. The same details apply to the jamb frames 14 and 15 on the area of the spandrel pane 11*a*. The introduction of the spacer member 13*a* allows an exterior of a building to present with a consistent surface, even with the use of glass of varying thicknesses. The other features are the same as explained for FIG. 3.

Figure 4:
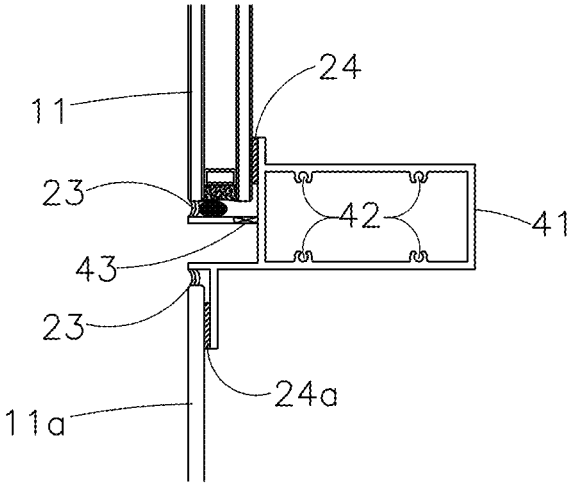
FIG. 4 is the fragmental cross-section of the stack member taken along Line 4-4 of FIG. 1**A.

FIG. 4 shows the fragmental cross-section of the stack member taken along Line 4-4 of FIG. 1A. The profile of the stack member may be non-symmetrical with the top being profiled to adapt a vision glass panel 11 and the bottom being profiled to adapt a spandrel pane 11*a*, as shown in the embodiment depicted in FIG. 4. Drainage holes 43 are provided to permit water to be drained from the unit. The water might possibly infiltrate through the water seal 23 into the airloop 25 around the vision glass perimeter edges. Multiple screw trails 42 may be provided on the stack member 41 for securing 41 to the jamb frames 14 and 15 with side screws (not shown). The dimensions of the stack member may be adjusted widely to accommodate vision and spandrel glass panels of varying thicknesses. The other features are the same as explained for the other figures.

The present invention thus permits a single frame to accommodate both vision glass and spandrel glass. As a result, the airloop wall system may be employed in diverse architectural conditions. This dramatically increases the utility of the airloop wall system by increasing the situations in which they may be employed.

Nothing in the above description is meant to limit the present invention to any specific materials, geometry, or orientation of elements. Various changes could be made in the construction and methods disclosed above without departing from the scope of the invention are contemplated within the scope of the present invention and will be apparent to those skilled in the art. For example, facing materials other than glass may be used. The embodiments described herein were presented by way of example only and should not be used to limit the scope of the invention.

The invention claimed is:

1. An airloop wall system, comprising:

a plurality of perimeter frame members that define a rectangular space into which a glass panel will be placed, where the plurality of perimeter frame members are secured to one another through miter-matched connections and where each perimeter frame member includes a glass panel-accommodating portion possessing a cross-sectional shape adapted to accommodate the glass panel with 1) a support component that runs interior to and parallel to a face of the glass panel; and 2) a perimeter component that extends perpendicularly from the support component towards the exterior of the airloop wall system;

where a head perimeter frame member defines a top perimeter of the space and a sill perimeter frame member defines a bottom perimeter of the space, where the head perimeter frame member and the sill perimeter frame member include an interior component adapted to permit the airloop wall system to be secured to a building;

where an adhesive secures the glass panel to the support component and where a water seal is disposed between the glass panel and the perimeter component such that an airloop is formed between the perimeter frame unit and the glass panel; and where the perimeter frame members are hidden from view from the exterior of the airloop wall system when the glass panel is secured in place.

2. The airloop wall system of claim 1, where the glass panel is vision glass.

3. The airloop wall system of claim 1, where the glass panel is spandrel glass.

4. The airloop wall system of claim 3, further comprising a spacer member located between the spandrel glass panel and the support component of the perimeter frame members.

5. The airloop wall system of claim 4, wherein said spacer member is a structural block or a tube.

6. The airloop wall system of claim 1, where a glaze is secured over the exterior portion of the glass panel after it has been secured to the perimeter frame members.

7. The airloop wall system of claim 1, where the sill perimeter frame unit further includes air holes between the airloop and the building exterior.

8. The airloop wall system of claim 1, where the perimeter component also includes a water-repelling gasket.

9. An airloop wall system capable of accommodating two glass panels, comprising:

a plurality of perimeter frame members that define a rectangular space into which the two glass panels will be placed, where the plurality of perimeter frame members are secured to one another through miter-matched connections and where each perimeter frame member includes a glass panel-accommodating portion possessing a cross-sectional shape adapted to accommodate the two glass panels with 1) a support component that runs interior to and parallel to a face of the glass panel; and 2) a perimeter component that extends perpendicularly from the support component towards the exterior of the airloop wall system;

where a head perimeter frame member defines a top perimeter of the space and a sill perimeter frame member defines a bottom perimeter of the space, where the head perimeter frame member and the sill perimeter frame member include an interior component adapted to permit the airloop wall system to be secured to a building;

where an adhesive secures the glass panel to the support component and where a water seal is disposed between the glass panels and the perimeter component such that an airloop is formed between the perimeter frame unit and the glass panels; and a stack member dividing the rectangular space into a first space for accommodating a first glass panel and a second space for accommodating a second glass panel, where the stack member runs between perimeter frame members on opposite sides of the space;

where the perimeter frame members and stack member are hidden from view from the exterior of the airloop wall system when the two glass panels are secured in place.

10. The airloop wall system of claim 9, wherein the first glass panel is vision glass and the second glass panel is spandrel glass.

* * * * *